United States Patent [19]

Lynn

[11] 4,155,754

[45] May 22, 1979

[54] METHOD OF PRODUCING HIGH DENSITY IRON-BASE MATERIAL

[75] Inventor: Jean C. Lynn, Elmhurst, Ill.

[73] Assignee: AMSTED Industries Incorporated, Chicago, Ill.

[21] Appl. No.: 846,930

[22] Filed: Oct. 31, 1977

[51] Int. Cl.[2] ..... B22F 3/00

[52] U.S. Cl. ..... 75/200; 75/201; 75/203; 75/204; 75/211

[58] Field of Search ..... 75/200, 211, 203, 204, 75/201

[56] References Cited

U.S. PATENT DOCUMENTS

| | | | |
|---|---|---|---|
| 3,859,085 | 1/1975 | Kimura et al. | 75/200 |
| 3,937,630 | 2/1976 | Kimura et al. | 75/200 |

*Primary Examiner*—Brooks H. Hunt

*Attorney, Agent, or Firm*—Edward J. Brosius; Fred P. Kostka; John L. Schmitt

[57] ABSTRACT

A method of producing a high density iron-base material by a powdered metal process includes blending powder of a substantially eutectic alloy with carbon particles to increase the difference between the solidus and liquidus temperatures of the blend. The blend is then compacted and sintered at a temperature between the solidus and liquidus temperatures to achieve the desired high density.

5 Claims, 1 Drawing Figure

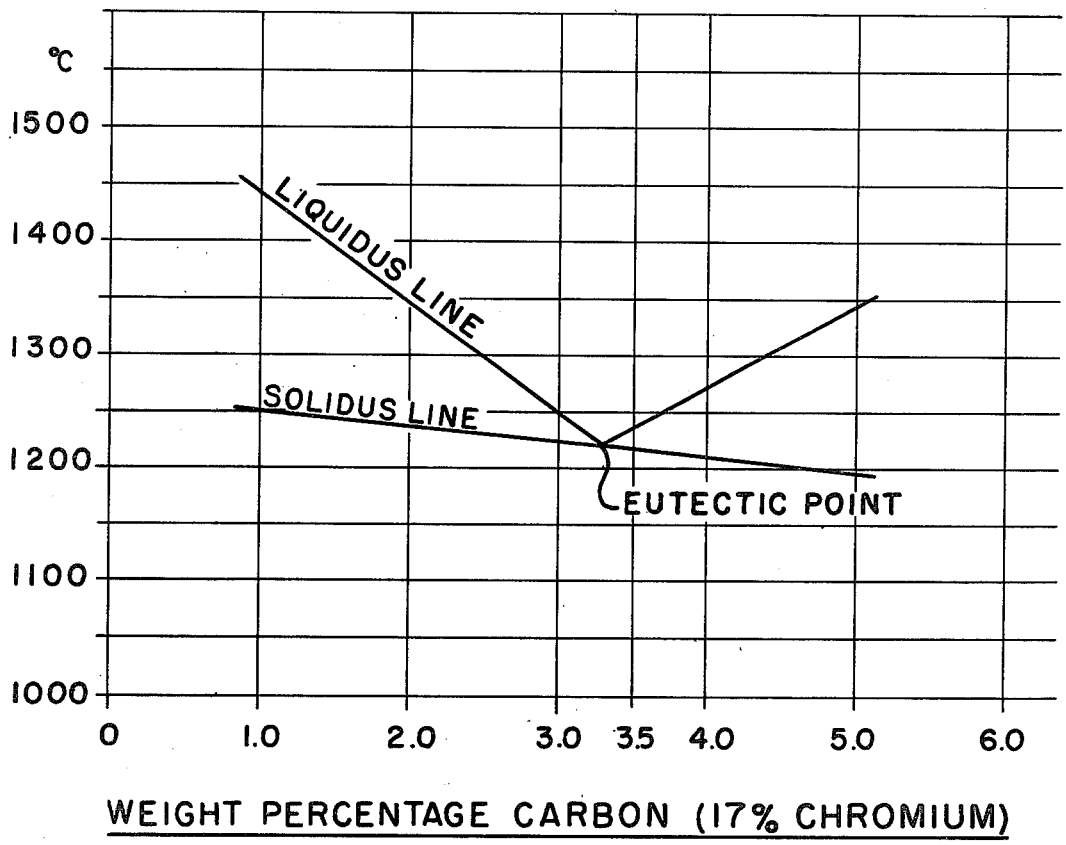
°C
1500
1400
1300
1200
1100
1000
LIQUIDUS LINE
SOLIDUS LINE
EUTECTIC POINT
0
1.0
2.0
3.0
3.5
4.0
5.0
6.0
WEIGHT PERCENTAGE CARBON (17% CHROMIUM)

METHOD OF PRODUCING HIGH DENSITY IRON-BASE MATERIAL

BACKGROUND AND SUMMARY OF THE INVENTION

This invention relates to a method of producing a high density iron-base material. It is more particularly concerned with a powdered metal process for producing an iron-base alloy wherein the desired high density is achieved by liquid phase sintering.

For various reasons, some parts or articles must be made of a material having certain special properties. Often, the most desirable method of producing such parts is by powdered metal methods. For example, parts or articles subjected to certain service conditions are preferably made of an alloy having a high wear resistance. Materials having the required wear resistance are generally extremely difficult or impossible to machine into the desired configuration. Generally, articles made of these alloys are produced in the form of castings and ground to the desired dimensions.

Casting of wear resistant articles may be satisfactory for the production of relatively large parts, but it may be impractical or uneconomical for the production of smaller articles. Therefore, it is desirable to be able to produce such smaller articles by a powdered metal process.

In a powdered metal process of producing these articles, the high density required may be achieved by liquid phase sintering. That is, the compacted article is sintered at a temperature between the solidus and liquidus temperatures of the particular alloy being produced in order to achieve a density of nearly the full theoretical density of the material.

However, some alloys which have very desirable properties such as high wear resistance are substantially eutectic. That is, their solidus and liquidus temperatures coincide or are so nearly equal that it is impractical to control the sintering temperature accurately enough to sinter an article between the two temperatures. Therefore, economical commercial production by powdered metal methods of articles made of substantially eutectic materials has been virtually impossible heretofore.

It is therefore an object of the present invention to provide a method for producing a high density iron-base material by a powdered metal process that overcomes the difficulties encountered heretofore.

According to the present invention, this is accomplished by adding carbon particles to powders of a substantially eutectic alloy, thereby increasing the difference between the solidus and liquidus temperatures and facilitating liquid phase sintering.

BRIEF DESCRIPTION OF THE DRAWING

The drawing is a portion of the phase diagram in relation to carbon content for an iron-base alloy having a chromium content of about 17%.

DESCRIPTION OF THE PREFERRED EMBODIMENT

Phase diagrams show the temperatures within which various phases of an alloy are present and the boundaries at which phase changes occur. Referring to the drawing, the solidus and liquidus lines of an iron-base alloy having a chromium content of about 17% are shown from a carbon content of about 1% to about 5%. The solidus line represents the temperature below which all components of the particular alloy are in a solid phase. The liquidus line represents the temperature above which all components of the particular alloy are in a liquid phase. At temperatures between the solidus and liquidus lines some solid phase is present and some liquid phase is present.

The drawing shows that as the carbon content increases from about 1%, the solidus and liquidus lines converge until they meet at a point representing a carbon content of about 3.3% at a temperature of about 1220° C. With further increase of carbon content, the lines rapidly diverge.

The point at which the solidus and liquidus lines meet is designated as the eutectic point. That is, if the alloy having the phase diagram as represented by the drawing has a carbon content of 3.3%, at a temperature below 1220° C. all components of the alloy will be in a solid phase, and at a temperature above 1220° C. all components will be in a liquid phase.

Under these conditions it is theoretically impossible to perform liquid phase sintering of an alloy that is eutectic because there is no difference between the solidus and liquidus temperatures. A temperature can be determined between the solidus and liquidus temperatures of an alloy having a carbon content that approaches the eutectic point. However, the width of the liquid phase sintering range of such an alloy might be so narrow that it would be economically impractical to control the sintering temperature accurately enough in a commercial production operation.

This would be true for the iron-base alloy of the drawing if the carbon content were between about 3 and 3.5%. At 3% carbon, the solidus temperature is about 1225° C., and the liquidus temperature is about 1250° C. Thus, the liquid phase sintering range is merely 25C°, which is too narrow a sintering range for practical commercial production of powdered metal articles.

Applicant has discovered that by increasing the carbon content of a substantially eutectic cold compactible powdered metal iron-base alloy, the difference between the liquidus and solidus temperatures may be increased sufficiently to provide a liquid phase sintering range which facilitates economical commercial production. Preferably the carbon content is increased by blending the cold compactible powder with carbon particles to achieve a carbon content of about 1 to 2 percentage points above that normally found in the substantially eutectic iron-base alloy. For example, if cold compactible powder of a 3% carbon alloy having a phase diagram as represented by the drawing is blended with an additional 1% by weight of carbon particles, the solidus temperature of the blend will be about 1210° C. and the liquidus temperature will be about 1270° C. Thus, the width of the liquid phase sintering range has been increased from about 25C° to about 60C°.

If 2% by weight of carbon particles is blended with cold compactible powder of the same alloy, the solidus temperature (at 5% carbon in the drawing) is now about 1195° C. and the liquidus temperature is about 1345° C. The width of the liquid phase sintering range has therefore been increased to about 150C°. Temperature ranges as broad as 60° or 150C° can be controlled economically in a commercial production operation.

Moreover, it has been found that the additional 1 to 2% carbon by weight has little or no effect on the properties of the resulting alloy. That is, the new higher carbon alloy has essentially the same characteristics as the substantially eutectic alloy from which it was produced.

It should be noted that in the preferred method of producing the high density iron-base material, the cold compactible powder of the substantially eutectic iron-base alloy is obtained by atomizing a melt having the same composition as the substantially eutectic alloy except for carbon content. The melt preferably has a carbon content of less than 0.2%. The powder obtained is cold compactible and can be blended with carbon particles to obtain the cold compactible powder of the substantially eutectic alloy. The details and advantages of this process are described more completely in U.S. patent application Ser. No. 651,554, which is incorporated herein by reference. When employing this method of practicing the present invention it should be noted that the desired result of broadening the liquid phase sintering range may also be accomplished by blending only enough carbon particles with the low carbon powder to obtain a blend having a lower carbon content than the eutectic alloy. That is, for example, if sufficient carbon particles were added to the low carbon powder to obtain a blend having a carbon content of only about 2%, the solidus temperature of the resulting alloy would be about 1240° C. and the liquidus temperature would be about 1345° C. The resulting liquid phase sintering range, therefore, would be about 105C°. As described above, a temperature range of 105C° can be controlled economically in a commercial production operation.

According to the present invention, the cold compactible powder may be obtained in any other manner desired. For example, a melt of the substantially eutectic iron-base alloy, including carbon, may be atomized to produce a hardened powder that cannot be cold compacted. The hardened powder may be treated to render it suitable for cold compaction.

The following is an example of applying the preferred method of the present invention to the production of a high density wear resistant material. One iron-base alloy which is normally cast into products and which has good wear resistant properties comprises the following analysis by weight:

| | |
|---|---|
| Chromium | About 17% |
| Molybdenum | About 16% |
| Cobalt | About 6% |
| Carbon | About 3% |
| Vanadium | About 1.9% |
| Silicon | About 1.5% maximum |
| Manganese | About 1% maximum |
| Nickel | About 0% |
| Others | About 3% maximum |
| Iron | Essentially balance |

At 3% carbon by weight, this alloy is substantially eutectic, but as the carbon content is increased above 3%, the solidus and liquidus temperatures diverge along lines in much the same manner as graphically illustrated by a solidus and liquidus lines of the drawing. However, the phase diagram of the drawing is not exactly the phase diagram of the alloy of this example. The alloy described above is available commercially and is known as Haynes Alloy #93.

A heat of this alloy except for the carbon content was water atomized and screened to provide a −88 mesh cold compactible powdered metal having the following analysis by weight:

| | |
|---|---|
| Chromium | About 17% |
| Molybdenum | About 16% |
| Cobalt | About 6% |
| Carbon | About 0.2% maximum |
| Vanadium | About 1.9% |
| Silicon | About 1.5% maximum |
| Manganese | About 1% maximum |
| Nickel | About 0% |
| Others | About 3% maximum |
| Iron | Essentially balance. |

The powdered metal was blended with 4% by weight natural graphite to achieve the desired elevated carbon content. The blend of powdered metal and graphite was then cold compacted in a closed die at about 7025 kg/cm$^2$ to form blanks about 2.5 cm in diameter and about 0.75 cm thick. The green blanks had a density of about 5.65 gm/cc, or about 72.7% of the theoretical density. Finally, the blanks were sintered in a vacuum at 1165° C. for two hours.

It has been found that 99% theoretical density can be achieved with controllable dimensions using this method. The parts produced by this method have a wear resistance substantially equal to parts made of the eutectic cast Haynes Alloy #93.

What is claimed is:

1. A method of producing a high carbon, heat and abrasion resistant and high density, iron-base alloy having a final composition which includes at least 1% of one of the elements of the group consisting of chromium, vanadium, molybdenum and tungsten, said method comprising the steps of:

atomizing a melt having an initial carbon content of less than 0.2% for forming a cold compactible powder of an iron-base alloy, blending a quantity of carbon particles with said powder to increase the carbon content sufficiently so as to create a blend of powdered metal having a carbon content greater than the carbon content found at the eutectic point of said iron-base alloy so as to provide a greater difference between the solidus and liquidus temperatures than the difference normally present in a eutectic iron-base alloy, compressing said blend into a compacted blank in a die at a pressure in excess of 2800 kg/cm$^2$, removing said compacted blank from said die and then sintering said compacted blank at a temperature between the solidus and liquidus temperatures of said blend to provide a high density material.

2. The method of claim 1 wherein said cold compactible powder has a composition which comprises the following analysis:

| | |
|---|---|
| Chromium | About 17% |
| Molybdenum | About 16% |
| Cobalt | About 6% |
| Carbon | About 0.2% maximum |
| Vanadium | About 1.9% |
| Silicon | About 1.5% maximum |
| Manganese | About 1% maximum |
| Nickel | About 0% |
| Others | About 3% maximum |
| Iron | Essentially balance. |

3. The method of claim 1 wherein said carbon particles comprise about 3.8% to 4.8% of said blend by weight.

4. The method of claim 1 wherein said carbon particles comprise about 3.8% of said blend by weight and said sintering is performed at about 1165° C. for about two hours.

5. The method as described in claim 1 wherein said sintering is performed in a near vacuum.

* * * * *